United States Patent [19]

Lagus et al.

[11] 4,453,595

[45] Jun. 12, 1984

[54] METHOD OF MEASURING FRACTURE PRESSURE IN UNDERGROUND FORMATIONS

[75] Inventors: Peter L. Lagus, Olivenhain; Edward W. Peterson, Del Mar, both of Calif.

[73] Assignee: Maxwell Laboratories, Inc., San Diego, Calif.

[21] Appl. No.: 415,537

[22] Filed: Sep. 7, 1982

[51] Int. Cl.[3] ..... E21B 47/06

[52] U.S. Cl. ..... 166/250; 73/155; 166/308

[58] Field of Search ..... 166/250, 308, 177; 73/155

[56] References Cited

U.S. PATENT DOCUMENTS

| | | | |
|---|---|---|---|
| 2,851,109 | 9/1958 | Spearow | 166/308 X |
| 3,427,652 | 2/1969 | Seay | 166/250 |
| 4,372,380 | 2/1983 | Smith et al. | 166/250 |
| 4,392,376 | 7/1983 | Lagus et al. | 73/155 |
| 4,398,416 | 8/1983 | Nolte | 73/155 |

*Primary Examiner*—George A. Suchfield

*Attorney, Agent, or Firm*—Fitch, Even, Tabin & Flannery

[57] ABSTRACT

A method is disclosed for accurately measuring breakdown or fracture pressure by placing a variable volume device in immediate communication with a test interval formed in a borehole extending through an underground formation. Expansion of the variable volume device increases pressure in the test interval to the fracture pressure of the formation. The fracture pressure may be accurately measured by monitoring pressure in the test interval, expansion of the variable volume device then preferably being terminated in order to minimize the extent of fracture within the formation.

11 Claims, 2 Drawing Figures

METHOD OF MEASURING FRACTURE PRESSURE IN UNDERGROUND FORMATIONS

The present invention relates to a method for accurately determining the breakdown or fracture pressure of an underground formation and more particularly to such a method adapted to minimize the extent of fracture within the formation.

Hydrofracture or hydraulic fracture techniques have commonly been employed in underground formations for a number of purposes. Initially, extensive fracture is commonly induced in gas or oil bearing formations in order to increase production. In many applications, it is desirable to accurately characterize breakdown or fracture pressure of a selected underground formation without producing substantial actual fracture of the formation about a borehole. This problem is most apparent for example in formations to be employed for storage of radioactive waste material or the like. In such applications, it is particularly important to characterize the breakddown or fracture pressure of the formation in order to accurately, assess the mechanical strength and state of stress of the formation. At the same time, it is commonly desirable to avoid extensive fracture of the formation since all boreholes must be subsequently sealed in order to prevent radionuclide migration to the human environment. An additional important application is in the design of massive hydrofractures in tight gas sand or the like.

This problem is most severe where the borehole extends great distances beneath the surface Under such circumstances, increased pressure is commonly developed within the borehole by gas generation or fluid transmission from the surface to increase pressure within an isolated interval of the borehole. Because of the distance between the surface and the isolated test interval, it is difficult to accurately halt further pressurization of the isolated interval at the time that fracture occurs. For example, where fluid is being pumped from the surface through tubing or the like to an isolated interval located thousands of feet underground, the difficulty of precisely terminating fluid flow into the isolated region of the borehole is particularly apparent. Obviously, the introduction of any additional fluid into the isolated region of the borehole will tend to cause extensive fracture once the fracture pressure of the formation has been reached.

Accordingly, there has been found to remain a need for a method of overcoming problems of the type discussed above.

It is therefore an object of the invention to provide a method for very accurately inducing fracturing and measuring the breakdown or fracture pressure of an underground formation. This object is achieved by defining an isolated test interval along a borehole extending through a selected formation and arranging a variable volume device in the borehole in immediate communication with the test interval. With the test interval being filled with a substantially incompressible fluid, the variable volume device is then expanded in order to precisely increase pressure within the test interval to the breakdown or fracture pressure of the formation. The variable volume device is precisely controllable so that pressure increase within the test interval may be terminated substantially at the time that fracture commences in order to minimize the extent of fracture within the formation. By simultaneously monitoring selected pressure and/or flow conditions within the test interval, it is possible to accurately detect the breakdown or fracture pressure of the formation.

A guarded straddle packer assembly, as described in greater detail below, has been found particularly suitable for practicing the method of the invention.

Additional objects and advantages of the invention are made apparent in the following description having reference to the accompanying drawings.

Figure 1:
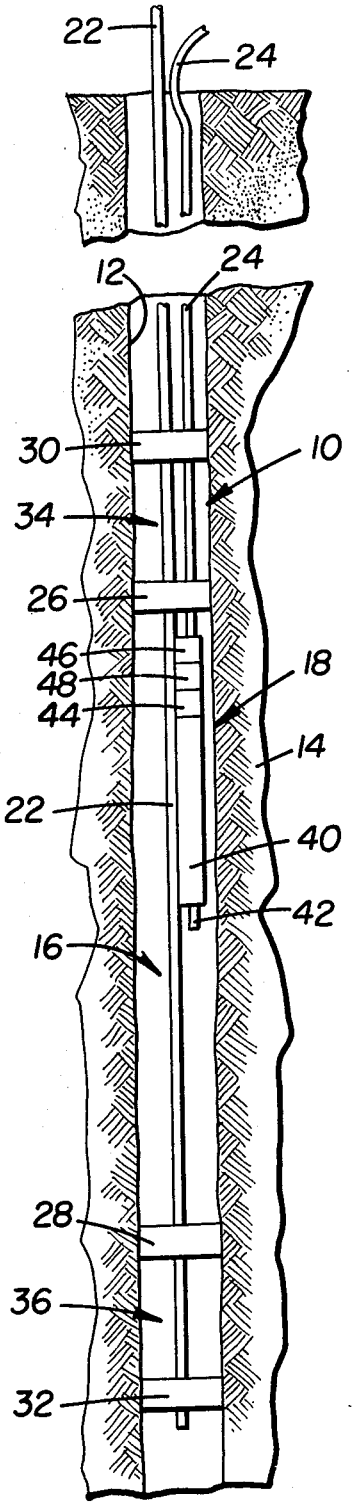
FIG. 1 is a generally schematic representation of a guarded packer assembly suitable for practicing the method of the present invention, the packer assembly being illustrated in a borehole along with a variable volume device and associated apparatus.

Referring now to the drawings and particularly to FIG. 1, the present invention contemplates a method for accurately determining the breakdown or fracture pressure of selected underground formation. The method employs a packer assembly 10 arranged within a borehole 12 extending through an underground formation of interest, as generally indicated at 14.

Figure 2:
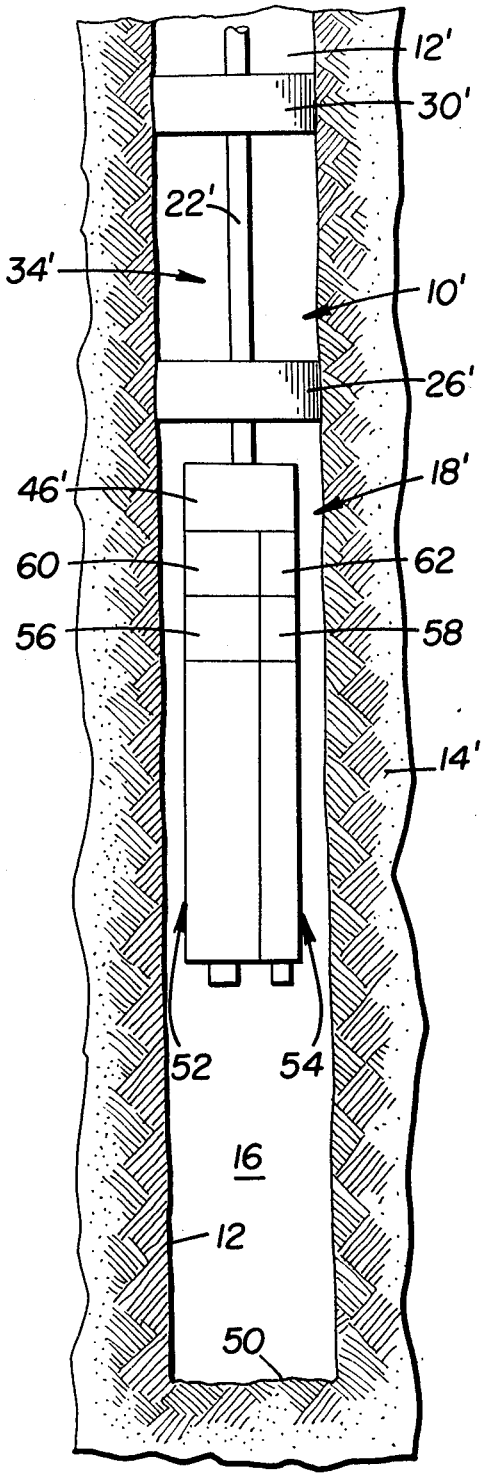
FIG. 2 is a schematic representation similar to FIG. 1 while including a modified variable volume device and packer assembly particularly adapted for use adjacent an end of the borehole.

It will be apparent that the method of the invention can be employed in boreholes of any orientation, for example vertical, horizontal or even slanted. Furthermore, the determination of fracture pressure may be determined in a test interval formed at any point along the length of a borehole as indicated for example in the embodiment of FIG. 1 or at an end of the borehole as indicated in the embodiment of FIG. 2.

The method of the invention contemplates the development of increased pressurization within a test interval 16, formed by the packer assembly 10, by means of a variable volume device 18 described in greater detail below. In accordance with the present invention, the variable volume device 18 is placed in immediate communication with the test interval. Preferably, the variable volume device 18 is entirely arranged within the test interval while the test interval is formed along the borehole adjacent a portion of the underground formation for which it is desired to determine the breakdown or fracture pressure.

As pressure is increased within the test interval 16 by the variable volume device 18, flow characteristics such as pressure are monitored within the test interval to determine the breakdown or fracture pressure as well as to possibly monitor other flow characteristics. With the variable volume device 18 being placed in immediate communication with the test interval 16, its operation may be immediately terminated upon reaching the breakdown or fracture pressure of the formation in order to limit the extent of fracture caused within the formation.

As will also be described in greater detail below, the test interval 16 may be formed by any conventional packer assembly or the like. However, the packer assembly 10 as illustrated in FIGS. 1 and 2 is preferably a guarded straddle packer assembly as described in greater detail below in order to permit more accurate measurements of the fracture geometry for the underground formations 14. A packer assembly and associated variable volume device of the type contemplated by the present invention is disclosed in a copending application U.S. Pat. Ser. No. 249,622 entitled "Method and Apparatus for Monitoring Borehole Conditions", filed on Mar. 31, 1981 by Peter L. Lagus et al under assignment to the assignee of the present invention, now U.S. Pat. No. 4,392,376 That application sets forth additional information regarding the use of a combined packer assembly and variable volume device and is accordingly incorporated herein as though set out in its entirety.

A guarded straddle packer assembly of the type preferably contemplated by the invention and illustrated in FIGS. 1 and 2 is also described in a copending application U.S. Pat. Ser. No. 202,076 entitled "Method and Apparatus for in situ Determination of Permeability and Porosity", filed on Oct. 30, 1980 by Peter L. Lagus et al under assignment to the assignee of the present invention, now U. S. Patent No. 4,353,249. That reference sets forth further information and additional discussion of the prior art concerning the measurement or inference of permeabilities from flow characteristics within a test interval defined along a borehole or the like. Accordingly, the disclosure of that reference is also incorporated herein as though set out in its entirety.

In accordance with the prior art and the copending references noted above, surface equipment (not shown) may be employed in conjunction with the packer assembly 10 both for locating the packer assembly within the borehole and for receiving monitored data from the test interval and other portions of the borehole as described in greater detail below.

Referring again particularly to FIG. 1, the packer assembly 10 and other apparatus of the invention as described below, is supported within the borehole by means of a tubing string 22, a tube bundle 24 providing necessary electrical, mechanical, hydraulic or pneumatic communication or signal transmission between the packer assembly and the surface for operating the packer assembly and variable control device and also for passage or monitored data.

The method of the invention contemplates the use of a variable volume device such as that indicated at 18 for pressurizing the test interval, especially as the pressure within the test interval approaches the breakdown or fracture pressure for the surrounding formation. Accordingly, it is possible in accordance with the present invention to employ other means for developing an initial pressure within the test interval as long as that initial pressure does not equal or exceed the breakdown or fracture pressure for the formation. For example, a separate variable volume device could be employed for initial pressurization of the test interval with the variable volume device 18 then serving to possibly pressurize the test interval more gradually in order to permit more precise measurement of the breakdown or fracture pressure. However, it will also be apparent that initial pressurization of the test interval 16 could also be developed for example by fluid transmission from the surface as long as the breakdown or fracture pressure of the surrounding formation is not closely approached or exceeded.

The use of a guarded straddle packer assembly as illustrated in FIG. 1 is preferably contemplated within the method of the invention to permit more accurate determination of fracture geometry within the test interval 16 in itself. As will be described in greater detail below and as may be seen in the references noted above, the use of a guarded straddle packer assembly permits more accurate determination of flow characteristics both within the underground formation 14 and along the borehole 12 itself for example because of leakage around the components of the packer assembly.

Referring again to FIG. 1, the packer assembly 10 includes two primary packers 26 and 28 for forming the test interval 16. In addition, guard packers 28 and 30 are arranged in spaced apart relation relative to the primary packers 18 and 20 in order to form isolated guard regions 34 and 36 at opposite ends of the test interval 16. With such an arrangement, flow conditions including but not limited to pressure, volumetric change, temperature, etc., may be monitored in the guard regions 34 and 36 as well as in the test interval 16 itself in order to better measure characteristics within the borehole and the surrounding formation 14.

Operation of the guarded straddle packer assembly 10 for developing information of the type referred to above is described in detail within the above-noted copending references. In any event, monitoring a flow condition within the guard regions particularly permits the detection and elimination of leakage effects about the individual packers. As was also indicated in the above-noted references, such determinations may be further facilitated for example by the use of tracer materials for better assessing leakage of fluid along the borehole for example.

The packers 26, 28 and 30, 32 are of conventional type, the specific construction of the packer assembly not being a feature of the present invention except to form the test interval 16. Very generally, the packers are preferably of an expandable or inflatable type so that they may be urged into feeling engagement with the borehole to define and isolate the test interval 16 as well as the guard regions 32 and 34.

The tube bundle 24 includes means for communicating necessary electrical, mechanical, hydraulic or pneumatic data to the surface. For example, the tube bundle may include lines for communication with pressure transducers and thermisters (not shown) arranged within the various isolated chambers formed by the packer assembly.

The variable volume device 18 preferably includes a cylinder 40 extending alongside the tubing string 22, a piston 42 being arranged in sealed relation within the cylinder while being extendable and retractable in order to provide a varying effective volume within the test interval itself. Extension and retraction of the piston within the cylinder may be accomplished by any of a variety of conventional means. Preferably, the cylinder and piston assembly is operated by a conventional stepper motor schematically illustrated at 44.

The cylinder and piston assembly may operate at a predetermined rate of volume change or a variable rate determined for example by a signal communicated through the tube bundle 24. Preferably, the cylinder and piston assembly is adapted for operation in response to a pressure monitoring transducer 46 arranged in communication with the test interval 16 for instantaneously detecting pressure therein. The motor 44 for the cylinder and piston assembly is preferably interconnected with the pressure monitor 46 by suitable interlinking means such as the servo mechanism indicated at 48 so that expansion of the cylinder and piston assembly may be terminated when the breakdown or fracture pressure of the surrounding formation is detected by the transducer 46.

It is believed that the method of operation for the present invention is apparent from the preceding description of the FIG. 1 embodiment. However, the method of the invention is described below in order to assure a full understanding thereof. Initially, the test interval 16 is filled with a substantially incompressible fluid or liquid. Pressure within the test interval 16 is then raised to a level below its breakdown or fracture pressure by any of a variety of means as described above. Thereafter, the variable volume device 18 is expanded to further increase pressure within the test interval 16 to approach its breakdown or fracture pressure. As the breakdown or fracture pressure of the formation is reached within the test interval, initial fracture will cause a rapid pressure drop which may be immediately determined by the transducer 46. At that point, operation of the variable volume device 18 may be immediately terminated in order to minimize fracture of the surrounding formation.

As was noted above, other flow characteristics may be monitored both within the test interval 16 and within the guard region 34 and 36 before, during and after reaching the breakdown or fracture pressure.

Another embodiment of the packer assembly and variable volume device is represented in FIG. 2. The packer assembly of FIG. 2 is a modification adapted for forming a test interval adjacent an end 50 of the borehole 12'. Since the embodiment of FIG. 2 includes components which closely conform to similar components in FIG. 1, primed numerical labels are important in FIG. 2 which corresponds to the numerical labels for the similar components of FIG. 1.

The packer assembly 10' of FIG. 2 includes a single primary packer 26' and a single guard packer 30'. The test interval, 16 is formed between the single primary packer 26' and the end of the borehole 50. A single guard region 34' is formed between the packers 26' and 30'.

The variable volume device 18' of FIG. 2 includes two cylinder and piston assemblies indicated respectively at 52 and 54. Each of the cylinder and piston assemblies 52 and 54 includes generally similar components as described for the single device 18 of FIG. 1. For example, each of the cylinder and piston assemblies is operated by respective motor means 56 and 58 through servo mechanisms 60 and 62 which are both responsive to the single pressure monitoring transducer 46'. The cylinder and piston assembly 52 has a relatively larger effective variable volume than the other cylinder and piston assembly 54.

In operation, the embodiment of FIG. 2 functions in essentially the same manner as described above in connection with FIG. 1. However, it is particularly to be noted that the larger cylinder and piston assembly 52 may be employed for initially pressurizing the test interval 16' to a pressure below the breakdown or fracture pressure of the surrounding formation. The smaller cylinder and piston assembly 54 may then be employed in the same manner described above in connection with FIG. 1 for approaching the actual breakdown or fracture pressure of the formation. Otherwise, the method contemplated with the apparatus of FIG. 2 is similar to that described above in connection with the apparatus of FIG. 1.

The method of the present invention has accordingly been described in detail above in connection with the separate embodiments of FIGS. 1 and 2. Various modifications and additions are believed apparent from the description. Accordingly, the scope of the invention is defined only by the following appended claims.

What is claimed is:

1. In a method for accurately measuring breakdown or fracture pressure of an underground formation, the steps comprising defining an isolated test interval along a borehole extending through the formation with at least one primary packer, arranging a variable volume device in the borehole in immediate communication with the test interval, filling the test interval with a substantially incompressible fluid, expanding the variable volume device and thereby increasing pressure in the test interval to the breakdown or fracture pressure of the formation, and simultaneously monitoring selected pressure and/or flow conditions within the test interval in order to accurately detect the breakdown or fracture pressure of the formation.

2. The method of claim 1 further comprising the step of terminating expansion of the variable volume device substantially simultaneously as pressure in the test interval reaches the breakdown or fracture pressure of the formation in order to minimize the extent of fracture in the formation.

3. The method of claim 1 or 2 wherein monitoring means are employed for detecting the breakdown or fracture pressure of the formation, the variable volume device being coupled with the monitoring means.

4. The method of claim 3 wherein the variable volume device is responsive to the monitoring means for terminating expansion of the variable volume device substantially upon the initiation of fracture.

5. The method of claim 1, wherein the monitoring means and the variable volume device are arranged in the test interval.

6. The method of claim 1 wherein the variable volume device comprises a cylinder and piston assembly.

7. The method of claim 1 wherein an initial pressure is developed within the test interval below the fracture pressure of the formation before expansion of the variable volume device.

8. The method of claim 7 wherein the initial pressure is developed by an additional variable volume device arranged in communication with the test interval.

9. The method of claim 1 wherein the test interval is formed between the one primary packer and an end of the borehole.

10. The method of claim 9 wherein a guard packer is arranged in spaced apart relation along the borehole relative to the primary packer for forming a guard region, pressure and/or flow conditions also being simultaneously monitored within the guard region.

11. The method of claim 1 wherein the test interval is formed by the one primary packer and an additional primary packer in the borehole, guard packers being arranged in spaced apart relation to the respective primary packers for forming guard regions at opposite ends of the test interval, pressure and/or flow conditions being simultaneously monitored within both guard regions.

* * * * *

UNITED STATES PATENT AND TRADEMARK OFFICE

CERTIFICATE OF CORRECTION

PATENT NO. : 4,453,595

DATED : June 12, 1984

INVENTOR(S) : Peter L. Lagus and Edward W. Peterson

It is certified that error appears in the above-identified patent and that said Letters Patent is hereby corrected as shown below:

Column 1, Lines 5 & 6: "acurately" should read --accurately--.

Column 1, Line 32: After "surface" insert a period (.).

Column 5, Line 35: After "interval" delete the comma (,).

Signed and Sealed this

*Second* Day of *April 1985*

[SEAL]

*Attest:*

DONALD J. QUIGG

*Attesting Officer*

*Acting Commissioner of Patents and Trademarks*